US009959963B2

(12) United States Patent
Koide et al.

(10) Patent No.: US 9,959,963 B2
(45) Date of Patent: May 1, 2018

(54) CURRENT CONTROLLER

(71) Applicant: KABUSHIKI KAISHA TOYOTA JIDOSHOKKI, Kariya-shi, Aichi-ken (JP)

(72) Inventors: Yukikazu Koide, Kariya (JP); Norihiko Kato, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 0 days. days.

(21) Appl. No.: 15/465,840

(22) Filed: Mar. 22, 2017

(65) Prior Publication Data

US 2017/0278610 A1 Sep. 28, 2017

(30) Foreign Application Priority Data

Mar. 24, 2016 (JP) ..... 2016-060531

(51) Int. Cl.

| | |
|---|---|
| ***H01F 7/06*** | (2006.01) |
| ***B66F 9/06*** | (2006.01) |
| ***B66F 9/24*** | (2006.01) |
| ***B66F 9/22*** | (2006.01) |

(52) U.S. Cl.

CPC ..... *H01F 7/064* (2013.01); *B66F 9/06* (2013.01); *B66F 9/22* (2013.01); *B66F 9/24* (2013.01)

(58) Field of Classification Search

CPC .... H01F 7/064; B66F 9/06; B66F 9/22; B66F 9/24

See application file for complete search history.

(56) References Cited

U.S. PATENT DOCUMENTS

| | | | | |
|---|---|---|---|---|
| 5,994,650 | A * | 11/1999 | Eriksson | B66F 9/122 177/141 |
| 2013/0167521 | A1 | 7/2013 | Tsuruta et al. | |
| 2015/0274497 | A1 | 10/2015 | Kato et al. | |
| 2017/0125145 | A1* | 5/2017 | Pecori | H01F 7/064 |

FOREIGN PATENT DOCUMENTS

| | | |
|---|---|---|
| JP | 2012-62137 A | 3/2012 |
| JP | 2015-187026 A | 10/2015 |

* cited by examiner

*Primary Examiner* — Faye M Fleming

(74) *Attorney, Agent, or Firm* — Sughrue Mion, PLLC

(57) ABSTRACT

A current controller includes a current control circuit and a current detection circuit, which detects a current flowing through a solenoid of an electromagnetic proportional relief valve. The current control circuit sets a current command to a sum of a value obtained by multiplying a feedforward gain by a target current value, a value obtained by multiplying a proportional gain by a current deviation, and a value obtained by multiplying an integral gain by a current deviation integral value. The current control circuit then controls the current flowing through the solenoid in accordance with the current command. When the current detected by the current detection circuit is less than or equal to the predetermined value, the current control circuit resets the current deviation and the current deviation integral value and sets the current command based on the reset values.

2 Claims, 2 Drawing Sheets

CURRENT CONTROLLER

BACKGROUND OF THE INVENTION

The present invention relates to a current controller that is configured to control a current flowing through a solenoid of an electromagnetic proportional relief valve.

For example, a forklift is known as an industrial vehicle that includes an engine and a hydraulic pump driven by the engine. A forklift operates a hydraulic actuator with hydraulic oil discharged from a hydraulic pump. The forklift, for example, includes hydraulic cylinders that are hydraulic actuators configured to move the fork upward or downward and hydraulic cylinders that are hydraulic actuators configured to tilt the mast assembly. The forklift also includes a control valve that controls supply and drainage of hydraulic oil, which is supplied from the hydraulic pump, to and from the hydraulic cylinders. When the hydraulic pump is driven by the engine, the engine torque may become insufficient as the load on the hydraulic pump increases, which may cause the engine to stall. Thus, conventionally, configurations for avoiding such engine stalls have been proposed. For example, refer to Japanese Laid-Open Patent Publication No. 2015-187026.

The industrial vehicle described in the above publication employs an electromagnetic control valve to supply and drain hydraulic oil. When the hydraulic actuators are not being operated, the industrial vehicle is always determined to be in the off-load state. In the off-load state, the pressure in the hydraulic mechanism is released to the oil tank, so that the pressure in the hydraulic mechanism is low. If load is applied to the engine and the on-load period at that time is less than a predetermined time, the hydraulic mechanism is controlled to be in the on-load state to increase the pressure in the hydraulic mechanism. Thereafter, the industrial vehicle is returned to the off-load state to prevent an abrupt increase in the pressure, so that the engine is prevented from stalling.

Also, an engine may be prevented from stalling by using an electromagnetic proportional relief valve to maintain the pressure acting on the hydraulic pump (the pressure of the hydraulic oil) at a value less than or equal to a relief pressure. The relief pressure of the electromagnetic proportional relief valve is regulated by current flowing through the solenoid. The current flowing through the solenoid is controlled by a current controller in accordance with a current command calculated based on the current deviation, which is the difference between a target current value corresponding to the relief pressure and the current flowing through the solenoid (the actual current). The actual current is detected by a current detection circuit. Thus, if a wire is broken or instantaneous interruption occurs in the current detection circuit, the current flowing through the solenoid cannot be detected. In such a case, the current deviation is increased, and the current command is increased, accordingly.

SUMMARY OF THE INVENTION

Accordingly, it is an objective of the present invention to provide a current controller capable of preventing a current command from being excessively increased even if a wire is broken or instantaneous interruption occurs in a current detection circuit.

To achieve the foregoing objective and in accordance with one aspect of the present invention, a current controller configured to be mounted in an industrial vehicle is provided. The industrial vehicle includes an engine, a hydraulic actuator driven with hydraulic pressure, a hydraulic pump driven by the engine, and an electromagnetic proportional relief valve. A relief pressure is adjusted by a current flowing through a solenoid, and when the relief pressure is exceeded, the electromagnetic proportional relief valve releases pressure in a hydraulic circuit that includes the hydraulic pump. The current controller is configured to control the current flowing through the solenoid and includes a current detection circuit and a current control circuit. The current detection circuit is configured to detect the current flowing through the solenoid. The current control circuit is configured to control the current flowing through the solenoid. The current control circuit is configured to set a current command to a sum of a value obtained by multiplying a feedforward gain by a target current value, a value obtained by multiplying a proportional gain by a current deviation, and a value obtained by multiplying an integral gain by a current deviation integral value, and to control the current flowing through the solenoid in accordance with the current command. The feedforward gain is set to a value greater than or equal to a value obtained by dividing a predetermined value that is smaller than a lower limit of a normal control range of the current flowing through the solenoid by the lower limit. When the current detected by the current detection circuit is less than or equal to the predetermined value, the current control circuit resets the current deviation and the current deviation integral value and sets the current command based on the reset values.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A current controller according to one embodiment will now be described. In this embodiment, the current controller is employed as a vehicle controller.

Figure 1:
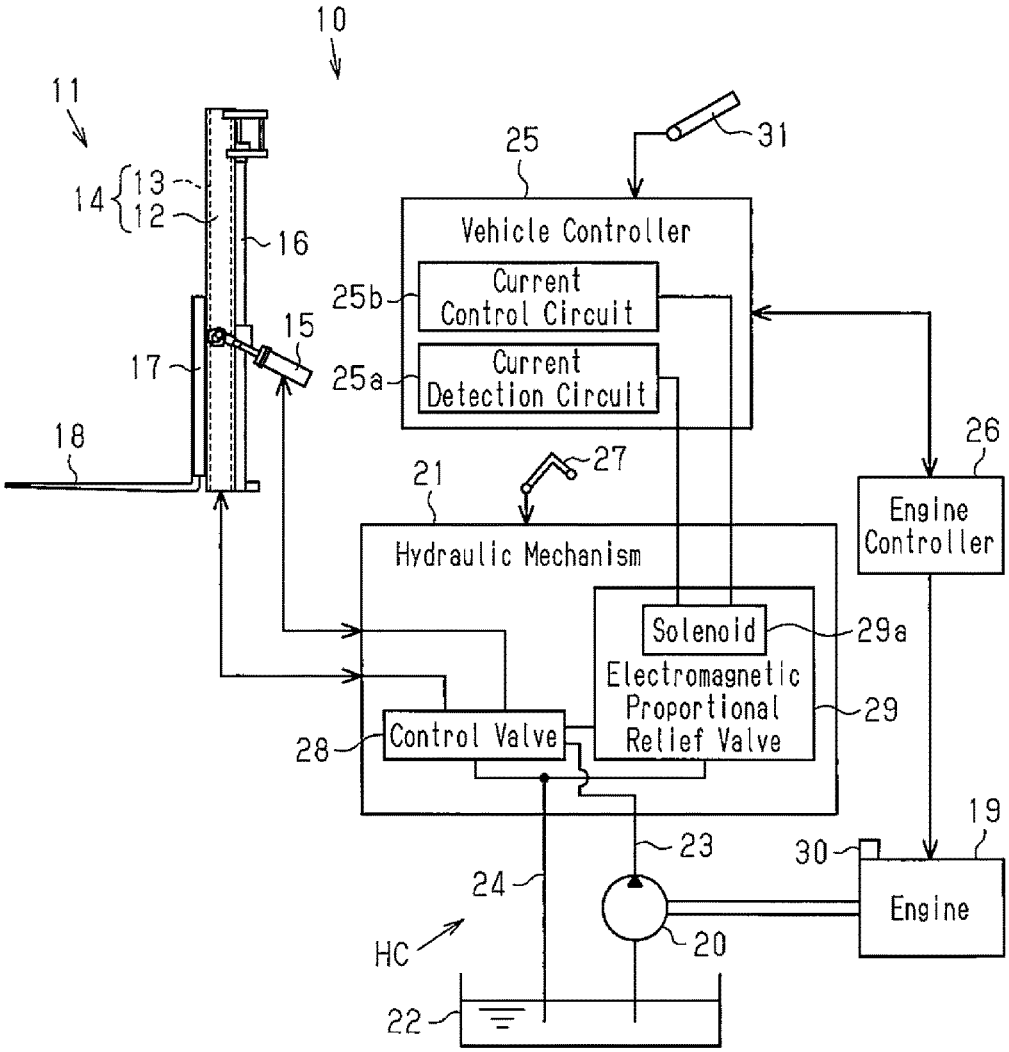
FIG. 1 is a schematic diagram of a forklift.

As shown in FIG. 1, a forklift 10, which is an industrial vehicle, includes a cargo handling device 11. The cargo handling device 11 includes a multistage mast assembly 14 that is constituted by a pair of left and right outer masts 12 and a pair of left and right inner masts 13. A hydraulic tilt cylinder 15, which is a hydraulic actuator, is coupled to each outer mast 12, and a hydraulic lift cylinder 16, which is a hydraulic actuator, is coupled to each inner mast 13. The mast assembly 14 is tilted forward or rearward in the vehicle front-rear direction when hydraulic oil is supplied to or drained from the tilt cylinders 15. The inner masts 13 are lifted or lowered in the vehicle vertical direction when hydraulic oil is supplied to or drained from the lift cylinders 16. A fork 18 is attached to the inner masts 13 with a lift bracket 17. When the lift cylinders 16 are actuated to lift or lower the inner masts 13, the fork 18 is lifted or lowered accordingly together with the lift bracket 17.

The forklift 10 includes an engine 19, a hydraulic pump 20, and a hydraulic mechanism 21. The engine 19 is a drive source for travelling operation and cargo handling operation of the forklift 10. The hydraulic pump 20 is driven by the engine 19. Hydraulic oil discharged from the hydraulic pump 20 is supplied to the hydraulic mechanism 21. Further, the forklift 10 includes an oil tank 22 that stores hydraulic oil and a rotation speed sensor 30 that detects the rotation speed of the engine 19 and outputs the actual rotation speed of the engine 19.

An oil passage 23 is connected to the hydraulic pump 20. The hydraulic pump 20 draws in hydraulic oil from the oil tank 22 and supplies the hydraulic oil to the hydraulic mechanism 21 through the oil passage 23. The oil passage 23 is connected to a discharge port of the hydraulic pump 20. The hydraulic mechanism 21 is connected to a drainage passage 24, through which the hydraulic oil is drained to the oil tank 22.

The hydraulic mechanism 21 includes a control valve 28 that controls supply and drainage of hydraulic oil to and from the respective cylinders 15, 16. Further, the hydraulic mechanism 21 includes an electromagnetic proportional relief valve 29 that is opened when a relief pressure is exceeded. The hydraulic pump 20 and the hydraulic mechanism 21, to which the hydraulic oil discharged by the hydraulic pump 20 is supplied, are included in a hydraulic circuit HC. When the pressure in the hydraulic circuit HC exceeds the relief pressure, the electromagnetic proportional relief valve 29 releases the pressure in the hydraulic circuit HC. This reduces the load on the hydraulic pump 20. The electromagnetic proportional relief valve 29 includes a solenoid 29*a*, and the relief pressure is adjusted by the current flowing through the solenoid 29*a*.

The forklift 10 has a vehicle controller 25 and an engine controller 26. The engine controller 26 is electrically connected to the vehicle controller 25.

The vehicle controller 25 controls the rotation speed of the engine 19 by outputting a rotation speed command for the engine 19 to the engine controller 26. The engine controller 26 controls the engine 19 based on the input rotation speed command. The engine controller 26 outputs the actual rotation speed of the engine 19 detected by the rotation speed sensor 30 to the vehicle controller 25. The forklift 10 uses the engine 19 to drive the hydraulic pump 20 and includes a cargo operating member 27, which is used to instruct operations of the tilt cylinders 15 and the lift cylinders 16. Thus, when the driver steps on an acceleration member 31 and manipulates the cargo operating member 27, at least one of the set of the tilt cylinders 15 and the set of the lift cylinders 16 can be activated.

In addition to the control of the engine controller 26, the vehicle controller 25 of the present embodiment also functions as a current controller that adjusts the relief pressure of the electromagnetic proportional relief valve 29 by controlling the current flowing through the solenoid 29*a*. The vehicle controller 25 includes a current detection circuit 25*a* and a current control circuit 25*b*. The current detection circuit 25*a* detects the current flowing through the solenoid 29*a* (the actual current). The current control circuit 25*b* includes a calculation section that calculates a current command and a control section that controls the current flowing to the solenoid 29*a* in accordance with the calculated current command.

The current control for the solenoid 29*a* performed by the vehicle controller 25 will now be described. The vehicle controller 25 performs the following current control at predetermined control cycles.

First, the vehicle controller 25 calculates the relief pressure required for the electromagnetic proportional relief valve 29. In the present embodiment, the relief pressure is calculated in accordance with the actual rotation speed of the engine 19, so that the load on the hydraulic pump 20 is prevented from increasing despite low output of the engine 19.

The current control circuit 25*b* of the vehicle controller 25 calculates a target current value CT to be supplied to the solenoid 29*a* based on the relief pressure required for the electromagnetic proportional relief valve 29 and performs current control such that a current of the target current value CT flows through the solenoid 29*a*. The current control is performed by the current control circuit 25*b* to control the current flowing through the solenoid 29*a* in accordance with a calculated current command CC.

Figure 2:
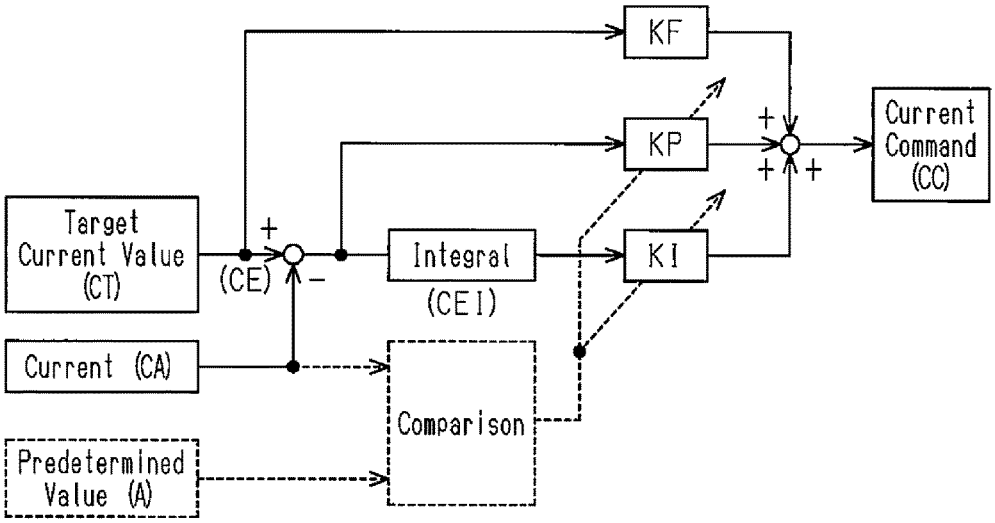
FIG. 2 is a control block diagram of a vehicle controller.

As indicated by the solid lines in FIG. 2, the current command CC is the sum of a value obtained by multiplying a feedforward gain KF by the target current value CT, a value obtained by multiplying a proportional gain KP by a current deviation CE, and a value obtained by multiplying an integral gain KI by a current deviation integral value CEI. The current command CC is thus expressed by the following expression (1).

$$\text{Current command CC} = KF \times \text{Target current value } CT + KP \times \text{Current Deviation } CE + KI \times \text{Current Deviation Integral Value } CEI \quad (1)$$

The current deviation CE is obtained by subtracting the current (the actual current) CA detected by the current detection circuit 25*a* from the target current value CT. The current deviation integral value CEI is obtained by adding the current deviation CE to the previous value of the current deviation integral value CEI (the current deviation integral value in the immediately preceding control cycle).

As described above, the vehicle controller 25 performs the current control by using both feedback control (proportional-integral control: PI control) and feedforward control. Furthermore, the vehicle controller 25 of the present embodiment resets the current deviation CE and the current deviation integral value CEI to zero when the following expression (2) is satisfied.

$$\text{Current } CA \leq \text{Predetermined Value } A \quad (2)$$

That is, as indicated by the broken lines in FIG. 2, when the current CA detected by the current detection circuit 25*a* becomes less than or equal to the predetermined value A, the current control circuit 25*b* resets the values of the current deviation CE and the current deviation integrated value CEI to zero and sets the current command CC based on the reset values.

The predetermined value A is smaller than the lower limit of the normal control range of the current flowing through the solenoid 29*a*. The normal control range is the range of the current value of the current flowing through the solenoid 29*a* and is set when the relief pressure of the electromagnetic proportional relief valve 29 is set to a pressure at which engine stall does not occur. Therefore, the lower limit of the normal control range is the current flowing through the solenoid 29*a* when the relief pressure of the electromagnetic proportional relief valve 29 is set to the minimum value of the pressure at which engine stall does not occur.

In the present embodiment, the predetermined value A is set to a value obtained by subtracting a margin from the lower limit of the normal control range of the current flowing through the solenoid 29*a*. The margin is used in consideration of noises in the current CA detected by the current detection circuit 25*a*. The predetermined value A is determined in advance based on the margin obtained through experimentation.

In the present embodiment, the feedforward gain KF is determined by the following expression (3).

$$\text{Feedforward Gain } KF \geq \text{Predetermined Value } A/\text{Lower Limit of Normal Control Range} \quad (3)$$

That is, the feedforward gain KF is set to a value greater than or equal to a value obtained by dividing the predetermined value A by the lower limit of the normal control range of the current flowing through the solenoid 29*a*. The proportional gain KP and the integral gain KI are set to values used in typical PI control.

Operation of the vehicle controller 25 of the present embodiment will now be described. For purposes of illustration, a case will be described in which the relief pressure required for the electromagnetic proportional relief valve 29 is constant.

First, a current controller of a comparative example will be described. The current controller of the comparative example is a typical current controller that calculates a current command CC based on a current deviation CE through PI control.

Figure 3:
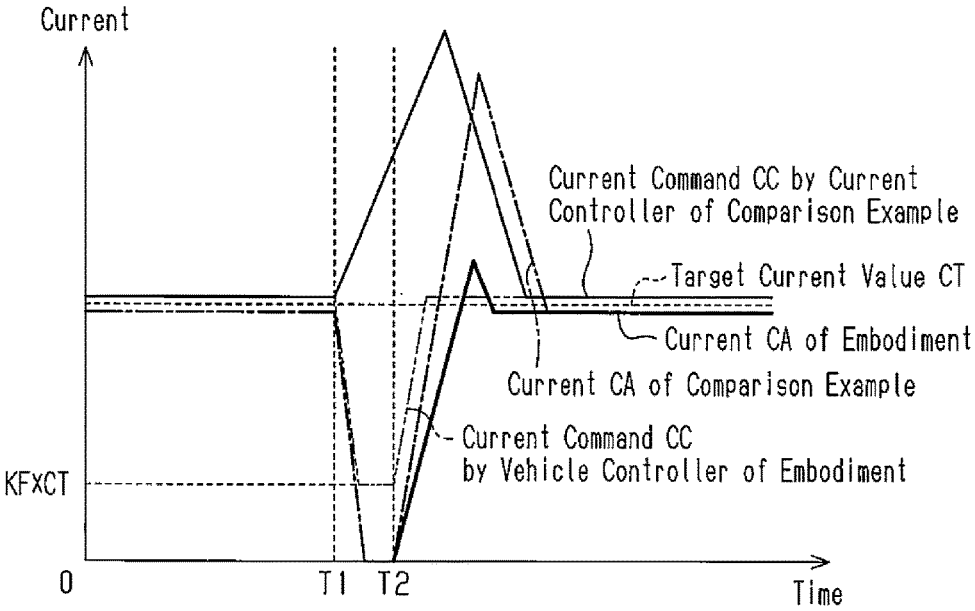
FIG. 3 is an explanatory diagram showing operation of the vehicle controller.

As shown in FIG. 3, since the relief pressure required for the electromagnetic proportional relief valve 29 is constant, the target current value CT for the solenoid 29*a* is also constant. Before point in time T1, the current CA detected by the current detection circuit 25*a* conforms to the target current value CT. When the current detection circuit 25*a* is instantaneously interrupted due to a contact failure, the current CA detected by the current detection circuit 25*a* becomes zero as indicated by the long dashed short dashed line in FIG. 3.

When the current CA detected by the current detection circuit 25*a* becomes zero, the current deviation CE increases. When the current deviation CE increases, the current controller of the comparative example increases the current command CC (the solid line in FIG. 3) in order to bring the current flowing through the solenoid 29*a* closer to the target current value CT. In addition, the solenoid 29*a* (coil) accumulates electromagnetic energy with the current flowing therethrough, and the current flowing through the solenoid 29*a* becomes excessively large from the effect of such energy accumulation. When the instantaneous interruption is resolved at point in time T2, the current command CC is also decreased, and the current flowing through the solenoid 29*a* conforms to the target current value CT.

The current controller (the vehicle controller 25) of the present embodiment will now be described.

When an instantaneous interruption occurs in the current detection circuit 25*a* of the vehicle controller 25 of the present embodiment at point in time T1 as indicated by the long dashed double-short dashed line FIG. 3, the current CA detected by the current detection circuit 25*a* becomes zero. That is, the current CA becomes less than or equal to the predetermined value A. As a result, the current control circuit 25*b* resets the current deviation CE and the current deviation integral value CEI. Since the current command CC is calculated based on a value of which the feedback term has been reset, the current command CC is obtained by multiplying the feed forward gain KF by the target current value CT. The feedforward gain KF and the target current value CT do not change with the current deviation CE. That is, even if the current deviation CE increases, the feedforward gain KF and the target current value CT do not increase, accordingly. Therefore, when an instantaneous interruption occurs, the current command CC is prevented from becoming excessively large, so that the current flowing through the solenoid 29*a* is prevented from becoming excessively large. When the instantaneous interruption is resolved at point in time T2, the current command CC is gradually increased.

When the instantaneous interruption is resolved at point in time T2, the current CA is gradually increased as indicated by the thick line in FIG. 3 as the current command CC is increased, and the current CA eventually reaches the target current value CT. At this time, although the current CA temporarily becomes slightly greater than the target current value CT due to the influence of the overshoot, the current CA is prevented from becoming a value significantly different from the target current value CT as compared with the current controller of the comparative example.

During the periods excluding the period from when the instantaneous interruption of the current detection circuit 25*a* occurs to when the instantaneous interruption is resolved (the period from point in time T1 to point in time T2), the vehicle controller 25 of the present embodiment calculates the current command CC in the same manner as the current controller of the comparative example.

Although the case where the current detection circuit 25*a* is instantaneously interrupted has been described, the current command CC is prevented from excessively increasing in the same manner even when the current detection circuit 25*a* has a broken wire.

The above-described embodiment achieves the following advantages.

(1) When the current CA detected by the current detection circuit 25*a* becomes smaller than the predetermined value A, the current control circuit 25*b* calculates the current command CC based on the value obtained by resetting the feedback term, and controls the current flowing through the solenoid 29*a* in accordance with the current command CC. Therefore, even if the current deviation CE increases due to a broken wire or instantaneous interruption in the current detection circuit 25*a*, the current command CC is prevented from becoming excessively large. As a result, excessive current is prevented from flowing through the solenoid 29*a*.

(2) The predetermined value A is obtained by subtracting the margin, which is employed in consideration of noises, from the lower limit of the normal control range of the current flowing through the solenoid 29*a*. Thus, in the case where a current the value of which is close to the lower limit of the normal control range is flowing through the solenoid 29*a*, the current CA detected by the current detection circuit 25*a* is prevented from becoming less than or equal to the predetermined value A even though there is no broken wire or instantaneous interruption in the current detection circuit 25*a*. Thus, the feedback term is prevented from being reset even though there is no broken wire or instantaneous interruption in the current detection circuit 25*a*. Therefore, it is possible to restrict a decrease in the responsiveness from being lowered by resetting the feedback term.

The embodiment may be modified as follows.

The predetermined value A may be different from the value obtained by subtracting the margin, which is employed in consideration of noises, from the lower limit of the normal control range of the current flowing through the solenoid 29*a*. Alternatively, the lower limit of the normal control range of the current flowing through the solenoid 29*a* may be set to the predetermined value A.

The pressure acting on the control valve 28 or the pressure in the hydraulic circuit may be detected with a pressure sensor, and the target current value CT may be calculated based on the detected pressure.

The target current value CT may be calculated based on the operation amount of the cargo operating member 27, which is manipulated by the driver to instruct the operation of the tilt cylinders 15 and the lift cylinders 16.

The industrial vehicle is not limited to the forklift 10, but may be any vehicle having a cargo handling device, such as a shovel loader.

The hydraulic actuators are not limited to the lift cylinders 16 and the tilt cylinders 15, but may also include cylinders used in an attachment such as a roll clamp.

Therefore, the present examples and embodiments are to be considered as illustrative and not restrictive and the invention is not to be limited to the details given herein, but may be modified within the scope and equivalence of the appended claims.

The invention claimed is:

1. A current controller configured to be mounted in an industrial vehicle, wherein the industrial vehicle includes an engine, a hydraulic actuator driven with hydraulic pressure, a hydraulic pump driven by the engine, and an electromagnetic proportional relief valve, wherein a relief pressure is adjusted by a current flowing through a solenoid, and when the relief pressure is exceeded, the electromagnetic proportional relief valve releases pressure in a hydraulic circuit that includes the hydraulic pump, the current controller is configured to control the current flowing through the solenoid and comprises:

a current detection circuit that is configured to detect the current flowing through the solenoid; and a current control circuit that is configured to control the current flowing through the solenoid, the current control circuit is configured to set a current command to a sum of a value obtained by multiplying a feedforward gain by a target current value, a value obtained by multiplying a proportional gain by a current deviation, and a value obtained by multiplying an integral gain by a current deviation integral value, and to control the current flowing through the solenoid in accordance with the current command, the feedforward gain is set to a value greater than or equal to a value obtained by dividing a predetermined value that is smaller than a lower limit of a normal control range of the current flowing through the solenoid by the lower limit, and when the current detected by the current detection circuit is less than or equal to the predetermined value, the current control circuit resets the current deviation and the current deviation integral value and sets the current command based on the reset values.

2. The current controller according to claim 1, wherein the predetermined value is less than a value obtained by subtracting a margin that is employed in consideration of noises from the lower limit of the current in the normal control range.

* * * * *